US006911965B2

(12) United States Patent
Miller, IV

(10) Patent No.: US 6,911,965 B2
(45) Date of Patent: Jun. 28, 2005

(54) WAVEFORM SEQUENCING METHOD AND APPARATUS FOR A BISTABLE CHOLESTERIC LIQUID CRYSTAL DISPLAY

(75) Inventor: Nick Martin Miller, IV, Rootstown, OH (US)

(73) Assignee: Kent Displays Incorporated, Kent, OH (US)

( * ) Notice: Subject to any disclaimer, the term of this patent is extended or adjusted under 35 U.S.C. 154(b) by 346 days.

(21) Appl. No.: 10/352,496

(22) Filed: Jan. 28, 2003

(65) Prior Publication Data

US 2004/0145548 A1 Jul. 29, 2004

(51) Int. Cl.[7] ..... G09G 3/36
(52) U.S. Cl. ..... 345/94; 345/95; 345/99
(58) Field of Search ..... 345/87, 90, 94, 345/95, 96, 79, 204, 208

(56) References Cited

U.S. PATENT DOCUMENTS

| | | | | |
|---|---|---|---|---|
| 5,453,863 A | | 9/1995 | West et al. | |
| 5,748,277 A | * | 5/1998 | Huang et al. | 349/169 |
| 6,133,895 A | | 10/2000 | Huang | |
| 6,154,190 A | * | 11/2000 | Yang et al. | 345/94 |
| 6,268,840 B1 | * | 7/2001 | Huang | 345/94 |
| 6,278,429 B1 | * | 8/2001 | Ruth et al. | 345/94 |
| 6,812,913 B2 | * | 11/2004 | Masazumi et al. | 345/94 |

OTHER PUBLICATIONS

Huang et al., Grayscale of Bistable Reflective Cholesteric Displays S1D97, pp. 810–813, SID 98 Digest.
Zhu et al., High–Speed Dynamic Drive Scheme for Bistable Reflective Cholesteric Displays, pp. 97–100, SID 97 Digest.
Huang et al., High–Performance Dynamic Drive Scheme for Bistable Reflective Cholesteric Displays, pp. 359–362, SID 96 Digest.
Huang et al., Dynamic Drive for Bistable Reflective Cholesteric Displays: A Rapid Addressing Scheme, pp. 165–168, Journal of the Sid (1995).

* cited by examiner

*Primary Examiner*—Kent Chang
(74) *Attorney, Agent, or Firm*—Pearne & Gordon LLP

(57) ABSTRACT

Reflective chiral nematic liquid crystal material is disposed between a first set of electrodes and a second set of electrodes arranged on opposed sides of the material to define a collection of pixels. Fast updating dynamic drive scheme is implemented by selectively applying an electric field via the electrodes through the pixels in four phases of energization: preparation, selection, evolution, and non-select. Each phase is made up of a series of voltages having varying amplitudes. The voltage waveform is for each phase controlled based on the selection phase to achieve image uniformity. For example, the evolution voltages that are established across adjacent pixels having the same final state have initial amplitudes that are equal for both pixels to increase image uniformity.

19 Claims, 4 Drawing Sheets

T1 T2 T3 T4

T1 T2 T4 T3

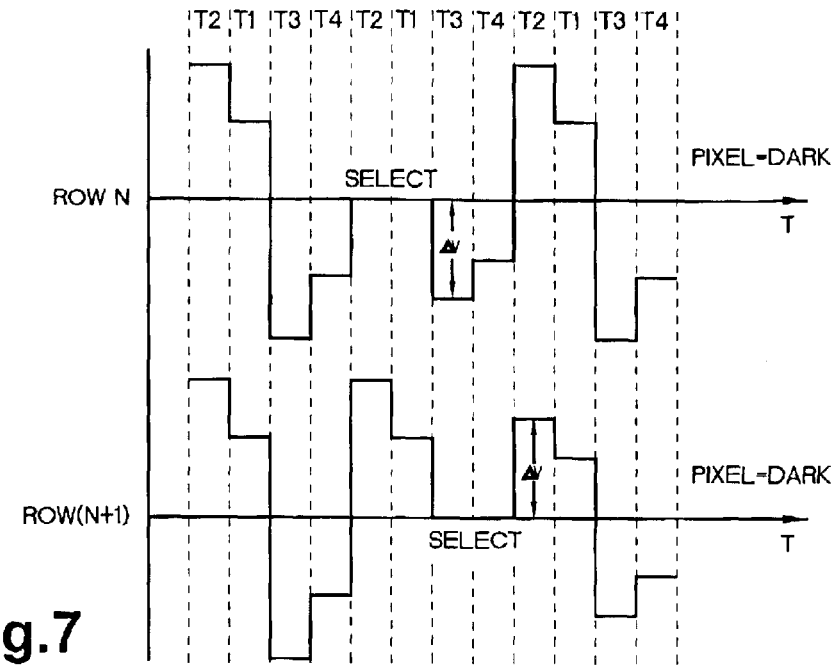
Fig.7
Fig.8
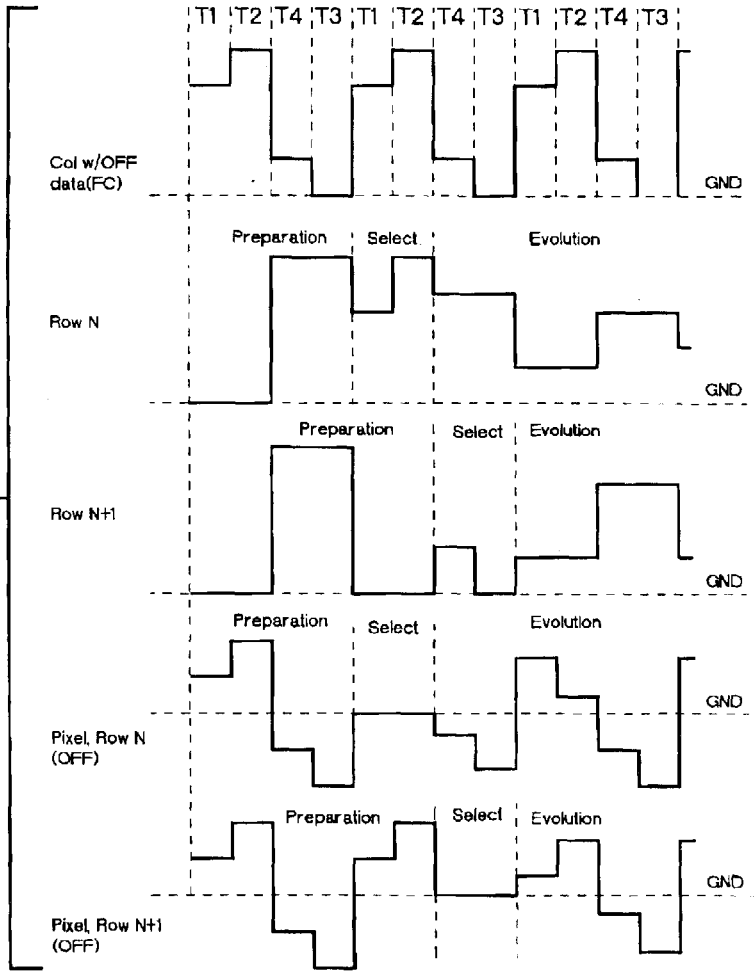

WAVEFORM SEQUENCING METHOD AND APPARATUS FOR A BISTABLE CHOLESTERIC LIQUID CRYSTAL DISPLAY

FIELD OF THE INVENTION

The present invention concerns a bistable display utilizing a chiral nematic liquid crystal material and an electronic drive system for activating the display using a sequence of voltages that enhances the appearance of the display.

BACKGROUND ART

Liquid crystals in flat panel displays have been used for many years, such as those used in watch faces or half page size displays for lap-top computers and the like.

Chiral nematic liquid crystal (or Cholesteric Liquid Crystal Material) material can be energized by application of a voltage to exhibit different optical states. Four representative states (textures) for the chiral nematic material are homeotropic, planar, transient planar, and focal conic. When in the homeotropic state, the liquid crystal material is transparent to normally incident light impinging upon the liquid crystal material. When in the focal conic state, the liquid crystal material weakly scatters the light, although if the path length is short enough material in this the state can appear transmissive, or black particularly when the back substrate is painted black. When in the planar state, the liquid crystal material reflects a pre-determined bandwidth of light. The final display state of each pixel of the liquid crystal display is typically selected to be in either the focal conic or planar state. The liquid crystal in the planar state reflects the light impinging upon the display to appear "light", and the liquid crystal in the focal conic state will appear transparent (black with a black background) to provide sufficient contrast with the planar pixels.

Bistable chiral nematic displays made up of reflective chiral nematic materials do not require continuous updating or refreshing. The electronics update the display when data or information is changed. However, if the display information does not change, the display does not need to be updated. Early bistable cholesteric liquid crystal displays suffered from long update times due to the long transition times between the planar and homeotropic states. This limited the applications of chiral nematic liquid crystal displays to those that could tolerate slow updates.

As cholesteric liquid crystal display technology developed, drive schemes such as that described in the technical paper by X. Y. Huang entitled "Dynamic Drive for Bistable Reflective Choleseric displays: A Rapid Addressing Scheme" that was published in the SID 1995 Technical Digest, and disclosed in U.S. Pat. No. 6,268,840 to Huang, incorporated herein by reference in its entirety, substantially reduced the update time for liquid crystal displays. The '840 patent discloses a "dynamic drive" method of implementing a dynamic drive scheme by applying unipolar row and column voltages to achieve a bipolar resultant pixel voltage using relatively simple drive circuitry while maintaining the update time at less than 1 millisecond per row of pixels. The '840 patent controlled the Root Mean Square (RMS) value of the voltage applied to each pixel to achieve the desired pixel state quickly by taking advantage of rapid transition of the cholesteric liquid crystal material from the homeotropic to the transient planar state. Sequences of discrete voltage levels are applied to the pixel to achieve the desired RMS values.

The dynamic drive scheme disclosed in the '840 patent is based on various properties of the liquid crystal material.

While not wanting to be bound by theory, some of those properties will be summarized herein. Transition between states occurs at different rates. For example, the transition between the homeotropic state and transient planar state is relatively fast (on the order of 1 millisecond at room temperature). The dynamic drive scheme makes use of this rapid transition when the liquid crystal material is holding in the homeotropic state and the electric field is reduced (by changing the pixel voltage) below a critical level known as $E_{HP}$*. The transition from the homeotropic to the focal conic state is slower (on the order of 10–100 milliseconds at room temperature). This transition takes place when the electric field is reduced to a level $E_{HF}$ that is generally higher than $E_{HP}$*.

According to the '840 patent, the pixel voltage is applied in four phases, preparation, selection, evolution, and non-select as can be seen in FIG. 1. The top waveform in FIG. 1 depicts a pixel being addressed to the focal conic state and the bottom waveform depicts a pixel being addressed to the planar state. In the preparation phase, a preparation voltage of about 50 volts RMS is applied to the pixel to transform the liquid crystal material in the pixel to the homeotropic state. With the liquid crystal material in the homeotropic state, if the electric field is above $E_{HF}$ (as in the selection voltage in the bottom waveform shown in FIG. 1), the liquid crystal will stay in the homeotropic state because the homeotropic state is metastable or stable. If the electric field is below $E_{HF}$ and above $E_{HP}$* (as in the selection voltage in the top waveform shown in FIG. 1), the liquid crystal will transform into the focal conic state. When the electric field is reduced further below $E_{HP}$*, the transition from homeotropic to the transient planar state also becomes possible. Competition between the two transitions (homeotropic to focal conic and homeotropic to transient planar) takes place and the faster transition (homeotropic to transient planar) will eventually dominate.

During the short selection phase of the dynamic drive, when the selection voltage is low (see top waveform of FIG. 1), the liquid crystal transforms into the transient planar state. When the selection voltage is high (bottom waveform of FIG. 1), the liquid crystal starts to transform to the focal conic state. However, the homeotropic to focal conic transition is very slow and at the end of the short selection phase, the liquid crystal is still mainly in the homeotropic state. To implement gray scale using the dynamic drive, the RMS of the selection voltage is varied to control the mixing ratio of the planar and focal conic states within a pixel to achieve a desired shade of gray. "Grayscale of Bistable Reflective Cholesteric Displays" by Xiao-Yang Huang et al. published in SID98 Technical Digest describes one way of using the dynamic drive and its derivative schemes to obtain gray scale.

During the evolution phase, a relatively high voltage (about 31 volts for typical display materials) is applied to the pixel so that the liquid crystal material is either maintained in a homeotropic configuration or evolves into a focal conic state. After the evolution voltage is removed, the pixel transforms to its final state, either focal conic or planar, depending upon the voltage applied during the selection phase. A relatively low (about 5V) RMS non-select voltage is maintained at the pixel until the end of the display update or the next preparation phase begins.

To achieve the drive scheme of the '840 patent, a sequence of waveforms are utilized to provide the desired resultant RMS pixel voltage for each phase in the drive scheme. These waveforms are selected to allow the creation of the necessary RMS voltages while preventing any net DC voltage. Each waveform is defined in four distinct drive phase sequences T1, T2, T3, and T4. A typical implementation of the dynamic drive scheme is shown as a pixel waveform for the planar or "on" pixel case in FIG. 2. This example implements a selection period of states T1, T2, T3, and T4. In order to reduce power, the time spent in each state can be increased and a two selection state waveform can be utilized as shown in FIG. 3. In the FIG. 3 case, the following row addressed will see a waveform with T3 and T4 selection states. Both the sequence shown in FIG. 2 and that shown in FIG. 3 will result in the same RMS waveform being applied to the pixel.

While the liquid crystal display described in the '840 patent performs well in terms of update speed and display quality with cost effective components, image degradation has been detected as well as a decrease in image update speed when certain sequences of drive states are applied to the pixels. In particular, the inventor of the present waveform sequencing method and apparatus has observed that adjacent rows of pixels that should have the same appearance alternate between "light" and "dark" in appearance. This "banding" effect can be most easily detected in the case of repeated focal conic ("dark") pixels including gray scale pixels.

SUMMARY OF THE INVENTION

A more uniform image can be provided and rapid update times can be maintained by applying a drive waveform to the pixels that is determined based on consideration of the entry and exit point of the selection phase of the waveform. For example, the waveform can be created so that it ensures that sequential pixels addressed to the focal conic state are energized during the evolution phase with an initial voltage having the same amplitude. The inventive drive scheme or waveform manipulation technique may provide equal transition time between homeotropic to transient planar states to pixels in adjacent rows to enhance image uniformity and enable precise pixel control necessary for gray scale addressing and applies to the dynamic drive scheme as well as its derivatives.

Chiral nematic liquid crystal material is disposed between a first set of electrodes and a second set of electrodes arranged on opposed sides of the material to define a collection of pixels. The electrodes selectively apply an electric field through the pixels in four phases of energization: preparation, selection, evolution, and non-select. The electrodes are energized to establish a preparation voltage across a first pixel during a preparation interval. Thereafter the electrodes are energized to establish a selection voltage across the first pixel during a selection interval that selects a final display state for the liquid crystal. An evolution voltage is then established across the first pixel during the evolution interval, and thereafter the first pixel is allowed to exhibit its final display state during a non-select interval. The electrodes are then energized as described in step a) to establish preparation, selection, and evolution voltages across a second pixel adjacent to the first pixel. When the selected final state for the first pixel and second pixel is the same, the evolution voltages (which are made up of a sequence of applied voltages including a first voltage having an initial amplitude) have initial amplitudes that are equal for both pixels.

While for the purposes of this description a "three phase" dynamic drive scheme (preparation, selection evolution, and non-select phases) is discussed, the practice of the invention is contemplated for four phase (including a pre-select phase) and "five phase" (including pre and post select phases) dynamic drive scheme implementation. The reader is directed to "High-Speed Dynamic Drive Scheme for Bistable Reflective Cholesteric Displays" by Zhu et al. published in the SID97 Technical Digest and "High-Performance Dynamic Drive Scheme for Bistable Reflective Cholesteric Displays" by Huang et al. published in the SID96 Technical Digest for a detailed description of the four and five phase drive schemes.

The collection of pixels is preferably arranged in a matrix and the first set of electrodes is disposed to energize selected rows of pixels and the second set of electrodes is disposed to energize selected columns of pixels and wherein the energizing steps a) and b) are performed by energizing the row and column electrodes to provide a desired resultant voltage to the first and second pixels. In one embodiment, the initial amplitude of the evolution voltage is no larger than the amplitudes of the other voltages in the sequence of voltages that make up the evolution voltage.

These and other objects, advantages, and features of the invention will be better understood from the accompanying detailed description of specific aspects of the invention when reviewed in conjunction with the accompanying drawings.

BRIEF DESCRIPTION OF THE DRAWINGS

FIG. 7 is a graph showing pixel waveforms applied to adjacent pixels to achieve a focal conic state according to an alternative embodiment of the present invention; and FIG. 8 is a graph showing row, column, and the resulting pixel waveforms applied to adjacent pixels to achieve a focal conic state according to an embodiment of the present invention.

DETAILED DESCRIPTION

The following description will focus on the waveforms that make up the drive sequence for a bistable chiral nematic liquid crystal display (LCD) panel. For the purposes of this description, a simple "on" and "off" (binary) display scheme is discussed, but it is to be understood that the techniques described herein can be easily extended to gray scale addressing. The voltage waveforms described herein can be implemented using control electronics that are part of the display described in detail in the '840 patent. The reader is directed to that patent for the technical specifications of a LCD appropriate for implementation of the drive techniques described herein.

Figure 1:
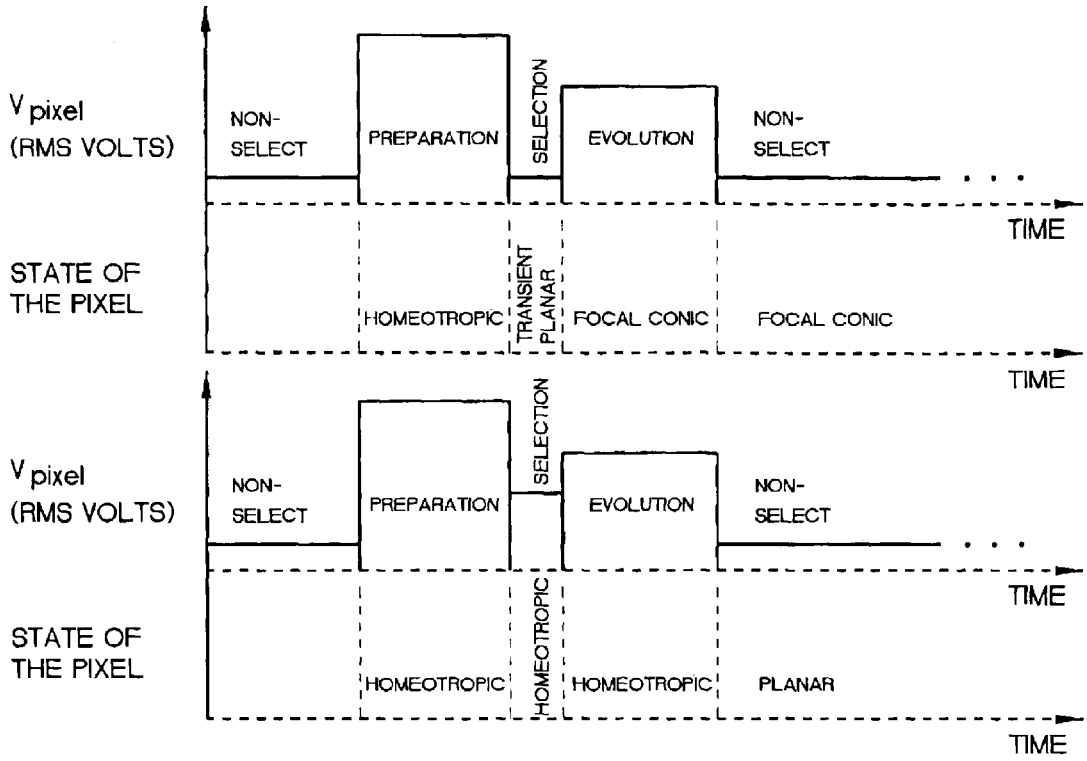
FIG. 1 is a graph showing a simplified sequence of RMS voltages applied to a pixel as a function to achieve a desired end pixel state.
Figure 2:
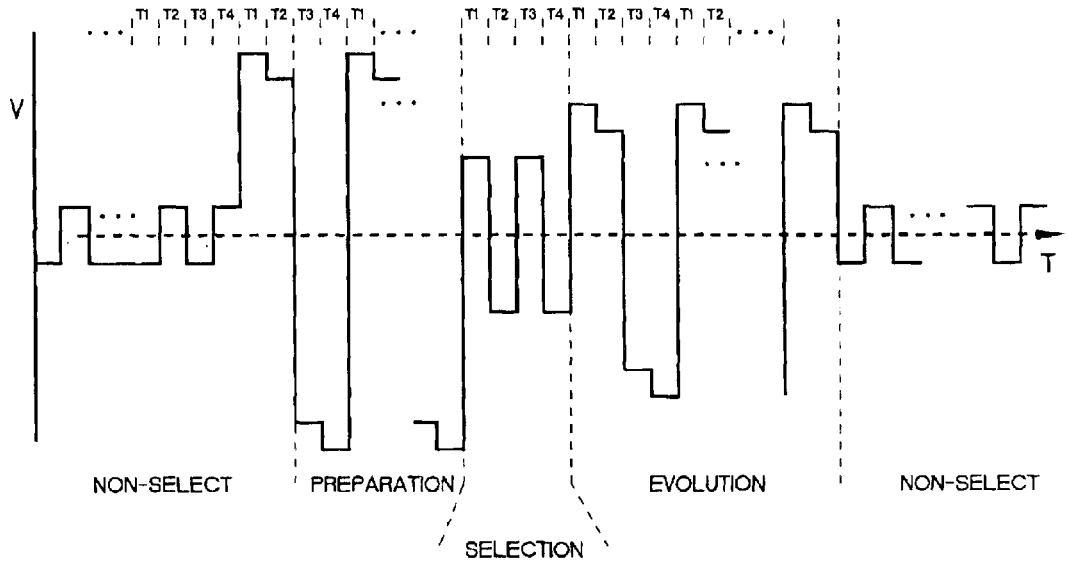
FIG. 2 is a graph showing a pixel waveform applied to achieve the RMS values depicted in FIG. 1.
Figure 3:
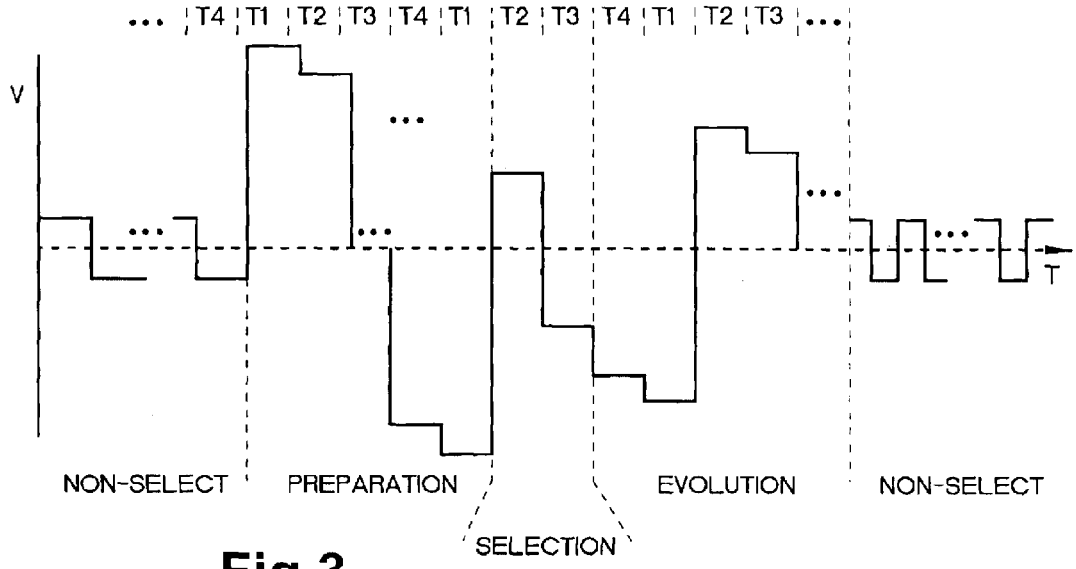
FIG. 3 is a graph showing an alternative pixel waveform applied to achieve RMS values depicted in FIG. 1.
Figure 4A:
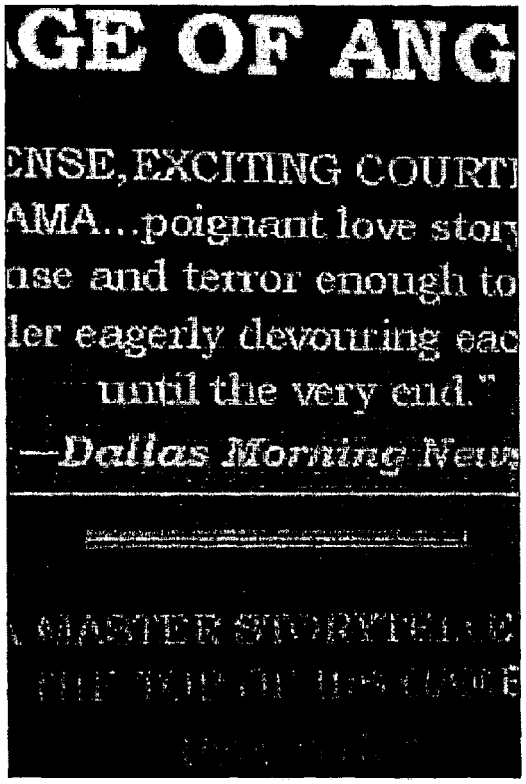
FIGS. 4A and 4B illustrate a liquid crystal display exhibiting a phenomenon known as "banding", and without banding, respectively.
Figure 4B:
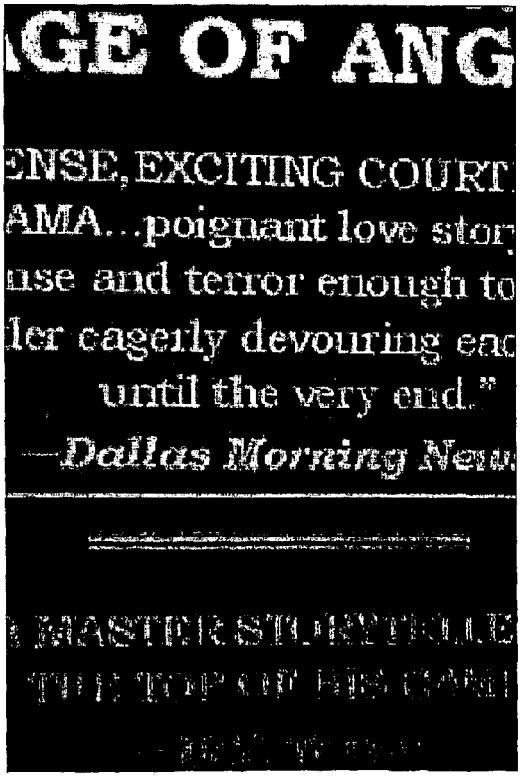

In experimental implementation of the dynamic drive scheme described in the '840 patent on a cholesteric liquid crystal display (Ch-LCD) panel, the inventor has observed an image anomaly known as "banding." This phenomenon is most easily observed in the areas of the display that are uniform, such that all of the pixels in a region of the display are of the same state or gray scale (such as either in the planar/"on" or focal conic/"off" state), possibly because the human eye more easily detects relatively slight differences in appearance between like pixels when all the pixels are supposed to be uniform in appearance. This is especially true in textures of low reflected luminance (dark texture areas of the display) as the eye is most sensitive to relative changes in intensity in these areas. Investigation of drive waveforms associated with the banding areas of the display found that the banding patterns were coincident with the drive waveform state periods. Using the waveform illustrated in FIG. 3, it was observed that every-other row in the dark pixel areas appeared lighter than neighboring rows as shown in the left image of FIG. 4.

Figure 5:
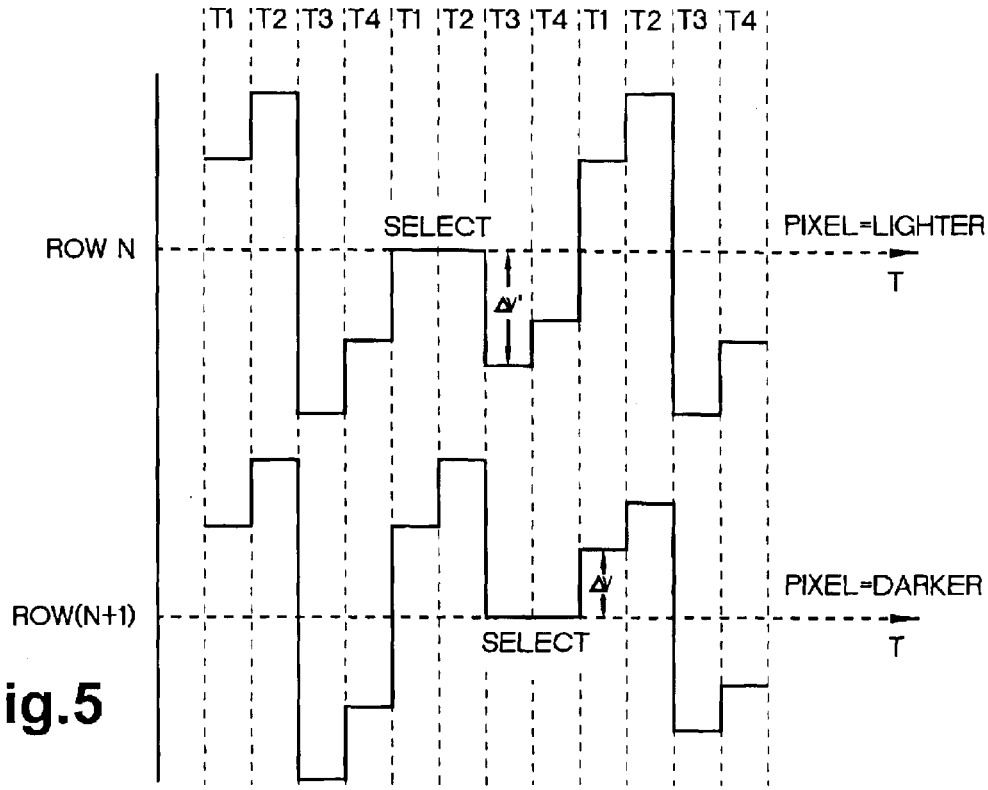
FIG. 5 is a graph showing pixel waveforms applied to adjacent pixels to achieve a focal conic state.

It was discovered that the rows appearing darker were addressed with the waveform shown in the bottom of FIG. 5 while the lighter rows of pixels were addressed by the waveform shown in the top of FIG. 5. It is believed that this banding occurs during the transition of the row from the waveform selection phase to the waveform evolution phase. This suggests that during the transition from the transient planar to the focal conic state, the amplitude of the initial voltage of the evolution state can affect the final state of the pixel. In other words, the final state of the pixel is not only dependent upon the RMS voltage but can also exhibit sensitivity to the sequence of the voltages that create the RMS resultant.

FIG. 5 illustrates the two state selection period waveforms seen by two pixels in adjacent rows of the same display column. In this image sequential rows, represented by Row (N) and Row (N+1), include pixels that are to be addressed to the "off" (focal conic) state that are within the same column. Additionally, the subsequent pixels of the same columns were addressed to the focal conic state. In this case, Row (N) selection period utilizes states T1 and T2 and the evolution period begins with the T3 state. Row (N+1) selection period utilizes states T3 and T4 and the evolution period begins with the T1 state. The difference in voltage between the final selection state and the first state of the evolution period is shown as $\Delta V$ and $\Delta V'$ in FIG. 5. It bears noting that $\Delta V'$ for Row (N) is less than the $\Delta V$ for Row (N+1). Although the RMS voltage of both evolution periods for both of these rows is the same, the effect of the difference between $\Delta V$ and $\Delta V'$ directly following the selection period causes a different final state. The pixel experiencing the Row (N) waveform will experience a different quantity of its domains entering into the transient planar state than the Row (N+1) pixel. This results in a different brightness of the final states for each respective row.

While not wanting to be bound by theory, it is believed that this row dependent brightness variation is only evident when all of the pixels in a section of the display are in the off state (focal conic or "dark"). In the '840 drive sequence, when a whole display section is addressed to the focal conic state, the immediate voltage following the selection phase varies depending on the column waveform applied to the subsequent row. For example, if a T1, T2, T3, T4 sequence is utilized, a pattern develops based upon whether the row is an odd row or an even row. If a higher voltage follows the selection phase, the liquid crystal will transform to a more homeotropic like state and the pixel will appear lighter after the evolution phase. If a lower voltage follows the selection phase, the liquid crystal will start to evolve to the focal conic state and the pixel will appear darker after the evolution phase.

In general, while not wanting to be bound by theory, the liquid crystal material responds to the root-mean-square (RMS) of the applied electric field or voltage. However, this general RMS rule requires that the characteristic transition time of the liquid crystal is much longer than the base time period of the voltage variation (e.g., about 5–10 times longer). When the final pixel state is in the on (planar) state, the liquid crystal exhibits the homeotropic-to-focal conic transition during the selection phase. Because the homeotropic-to-focal conic transition time (e.g., about 10 to 100 ms) is much longer than the base period of the pulse (e.g., about 1 ms), the response is RMS based. Therefore, the on-state brightness is not sensitive to the exact pixel waveform variation. During the evolution and preparation phases, the transition time is also much longer than the base period of the voltage, and the RMS rule applies.

It is believed that this sensitivity to the amplitude of the initial evolution voltage is due to the difference in transition time between the homeotropic to the transient planar state (about 1 ms) versus the homeotropic to focal conic state (about 100 ms) that occurs during the evolution phase. When the pixel is switched to the focal conic state, a fast homeotropic to transient planar transition occurs. The liquid crystal is able to respond to fast voltage waveform details and is not solely dependant on the RMS value. When a section of the display is being switched to the planar state, the transition is a relatively slow homeotropic to focal conic transition. During this transition, the liquid crystal is not sensitive to the fast voltage waveform variation. Therefore, it is believed that the row dependent brightness does not exist when the pixels are in the planar state. This banding effect can be compensated by increasing the time spent in each phase to accommodate the Row(N)pixel, but this solution sacrifices image update speed and prevents the precise pixel control required for gray scale addressing.

Figure 6:
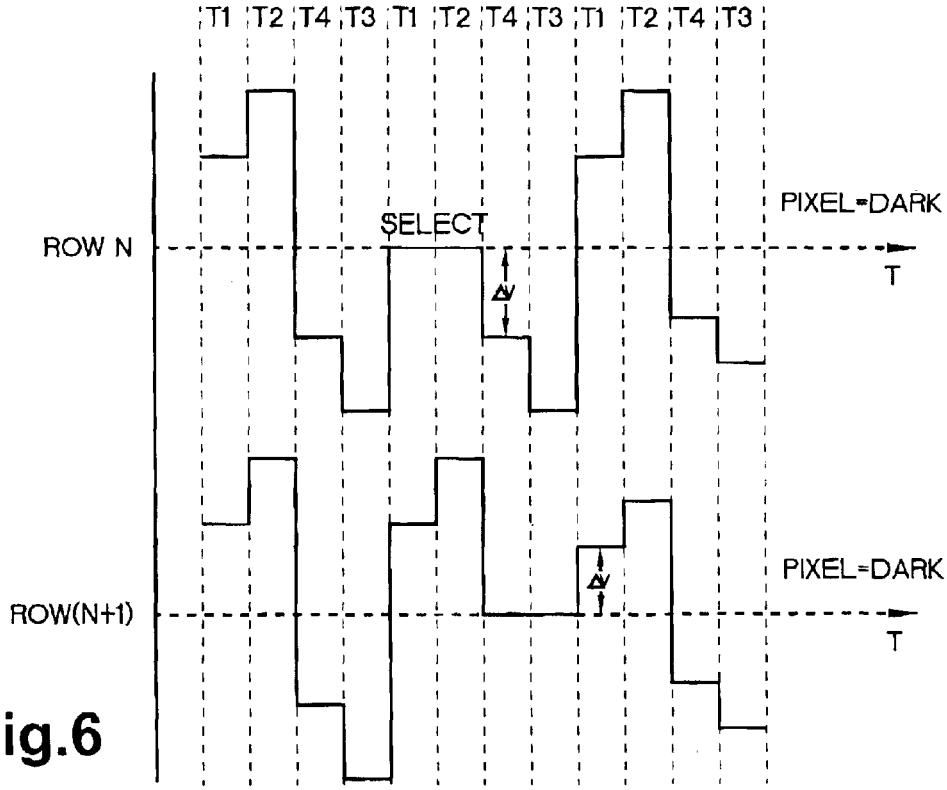
FIG. 6 is a graph showing pixel waveforms applied to adjacent pixels to achieve a focal conic state according to an embodiment of the present invention.

FIG. 6 illustrates the waveform manipulation technique where the drive sequence is modified such that the amplitude of the initial voltage of the evolution stage is the same for all rows for image areas that are sensitive to the banding phenomenon. This significantly reduces the banding effect. Preventing the banding effect in multiple rows of focal conic pixels is possible by modifying the drive phase sequence (T1, T2, T3, T4) to ensure that every row will enter the evolution stage at the same voltage as shown in FIG. 6. Manipulation of the drive phase sequence can force the voltages following the selection period to be the same $\Delta V$ amplitude as shown in FIG. 6 for the T1, T2, T4, T3 drive phase sequence and in FIG. 7 for a T2, T1, T3, T4 drive sequence.

To increase the update speed, the lowest $\Delta V$ value of FIG. 6 is preferable to the high $\Delta V$ value of FIG. 7 to synchronize the drive phase sequence. A lower value of evolution entry voltage ($\Delta V$) allows a smaller selection time period. Thus the entire waveform frequency can be increased to give a faster update, as the transient planar state to focal conic transition is not sacrificed, as would be the case with at T3 or T2 entry phase. The T1, T2, T4, T3 sequence waveform result is shown on the right of FIG. 4 in contrast to the T1, T2, T3, T4 sequence on the left. The use of the T1, T2, T4, T3 sequence makes the banding problem virtually imperceptible to the human eye.

The top three rows of FIG. 8 illustrate the sequence of voltages that are applied to row and column electrodes to address two adjacent pixels, in Row (N) and Row (N+1) to the focal conic/off state. The bottom two rows show the resultant pixel voltage that results from the electrode voltages. The column voltage waveform for any pixel addressed to the focal conic state is approximately 31 volts in T1, 43 volts in T2, 12 volts, in T4, and 0 volts in T3. Based on the column voltage, row voltages are selected so that they will sum with the column voltage to provide the desired resultant pixel voltages at the pixels in Rows (N) and (N+1). In this example Row (N) is supplied with 0 volts in T1 and T2 in the preparation phase and 43 volts in T4 and T3 of the preparation phase. The Row (N) selection phase consists of 31 volts in T1, 43 volts in T2, and the evolution phase is 33 volts in T4 and T3. T1 and T2 of the Row (N+1) evolution phase consist of a 10 volt pulse followed by a 33 volt pulse in T4 and T3. Row (N+1) has a selection phase that begins at 12 volts during T4 and ends at 0 volts during T3. The row evolution voltage for (N+1) is the same as that for (N), 10 volts in T1 and T2 and 33 volts in T4 and T3.

The pixel voltages for the adjacent pixels in Rows (N) and (N+1) can be seen in the bottom two rows of FIG. 8. The preparation voltage waveform is 31 volts in T1, 43 volts in T2, 31 volts in T4 and 43 volts in T3. The selection voltage consists of 0 volts applied for two periods, either T1 and T2 in Row (N)or T4 and T3 in Row (N+1). The evolution voltage is 21 volts and 33 volts in T1 and T2 respectively and 21 volts and 33 volts in T4 and T3, respectively. As can be seen from FIG. 8, both the Row (N) pixel and the Row (N+1) pixel are supplied with voltages of equal amplitude (21 volts) immediately after the selection phase. This means that both pixels will have the same state transition at the start of the evolution phase of the drive scheme.

It is contemplated that, within the scope of the invention, the sensitivity of the chiral nematic liquid crystal to the sequence of voltage levels of any of the phases of the drive scheme can be taken into consideration when determining an appropriate sequence of voltages to be applied to the pixel. The described embodiment concerns a method of implementing the dynamic drive waveform sequence to optimize the transition of the pixels when going into the evolution phase of the drive scheme. Different sequences can be utilized for other purposes such as optimizing the transition of the pixels at the entry into the selection phase of the drive scheme. The technique could be used to modify the drive sequence according to the image content or be leveraged for other display technologies.

As can be seen from the foregoing description, the dynamic drive update method can be modified to reduce the appearance of image anomalies that can be detected by the human eye especially in the case where wide sections of the display are in the dark state (as is the case of test images). The described technique allows the image to be more uniform over a larger operating range and thus enjoy a faster update rate as well as improved image uniformity.

What is claimed is:

1. A method for activating chiral nematic liquid crystal material disposed between a first set of electrodes and a second set of electrodes arranged on opposed sides of the material to define a collection of pixels and adapted to selectively apply an electric field through the pixels, the method comprising the steps of:

energizing the electrodes to establish across a first pixel a drive waveform comprising a predetermined preparation sequence of voltages, followed by a predetermined selection sequence of voltages, followed by a predetermined evolution sequence of voltages, and followed by a predetermined non-select sequence of voltages that is applied during an interval during which the first pixel exhibits a final display state that is determined by the selection sequence of voltages;

and wherein each of the preparation, selection, evolution, and non-select sequence of voltages comprises an entry voltage and an exit voltage and wherein at least one of the preparation, evolution, and non-select sequence of voltages is determined based on the entry and exit voltages of the selection sequence of voltages.

2. The method of claim 1 wherein at least one of the sequences of voltages comprises a sequence of approximately square wave pulses.

3. The method of claim 1 wherein the collection of pixels is arranged in a matrix and wherein the first set of electrodes is disposed to energize selected rows of pixels and the second set of electrodes is disposed to energize selected columns of pixels and wherein the energizing step is performed by energizing the row and column electrodes to provide a desired resultant sequence of voltages.

4. The method of claim 1 wherein an amplitude of the entry voltage of the evolution sequence of voltages is determined based on the entry and exit voltages of the selection sequence of voltages.

5. The method of claim 1 comprising the step of establishing a predetermined pre-selection sequence of voltages across the first pixel after establishing the preparation sequence of voltages across the first pixel and prior to establishing the selection sequence of voltages across the first pixel.

6. The method of claim 1 comprising the step of establishing a predetermined post-selection sequence of voltages across the first pixel after establishing the selection sequence of voltages across the first pixel and prior to establishing the non-select sequence of voltages across the first pixel.

7. The method of claim 1 comprising the step of establishing the drive waveform across a second pixel adjacent to the first pixel.

8. Display apparatus comprising:

a) a layer of reflective chiral nematic liquid crystal material arranged as pixels;

b) a first set of electrodes and a second set of electrodes spaced on opposite sides of the liquid crystal layer for applying selected energization voltages across multiple pixels; and c) control electronics for setting a display state of the pixels comprising circuitry for:

energizing the electrodes to establish across a first pixel a drive waveform comprising a predetermined preparation sequence of voltages, followed by a predetermined selection sequence of voltages, followed by a predetermined evolution sequence of voltages, and followed by a predetermined non-select sequence of voltages that is applied during an interval during which the first pixel exhibits a final display state that is determined by the selection sequence of voltages;

and wherein each of the preparation, selection, evolution, and non-select sequence of voltages comprises an entry voltage and an exit voltage and wherein at least one of the preparation, evolution, and non-select sequence of voltages is determined based on the entry and exit voltages of the selection sequence of voltages.

9. A method for activating chiral nematic liquid crystal material disposed between a first set of electrodes and a second set of electrodes arranged on opposed sides of the material to define a collection of pixels and adapted to selectively apply an electric field through the pixels, the method comprising the steps of:

a) energizing the electrodes to establish a preparation voltage across a first pixel during a preparation interval, thereafter energizing the electrodes to establish a selection voltage across the first pixel during a selection interval for selecting a final display state for the liquid crystal; thereafter energizing the electrodes to establish an evolution voltage across the first pixel during an evolution interval, and thereafter permitting the first pixel to exhibit its final display state during a non-select interval;

b) energizing the electrodes as described in step a) to establish preparation, selection, and evolution voltages across a second pixel adjacent to said first pixel; and c) wherein the selected final state for the first pixel and second pixel is the same, and wherein the evolution voltage comprises a sequence of applied voltages comprising a first voltage having an initial amplitude, and wherein the initial amplitude of the evolution voltage for the first pixel is equal to the initial amplitude of the evolution voltage for the second pixel.

10. The method of claim 9 wherein the collection of pixels is arranged in a matrix and wherein the first set of electrodes is disposed to energize selected rows of pixels and the second set of electrodes is disposed to energize selected columns of pixels and wherein the energizing steps a) and b) are performed by energizing the row and column electrodes to provide a desired resultant voltage to the first and second pixels.

11. The method of claim 9 wherein the initial amplitude is no larger than the amplitudes of the other applied voltages in the sequence.

12. The method of claim 9 wherein the sequence of applied voltages in the evolution voltage comprises a sequence of discrete voltage pulses comprising an initial pulse having an initial amplitude wherein the initial amplitude is no larger than the amplitudes of the other pulses in the sequence.

13. The method of claim 9 wherein the predetermined final state is focal conic.

14. The method of claim 9 comprising the step of energizing the electrodes to establish a pre-selection voltage across the first and second pixels after establishing the preparation voltage across the pixels but prior to establishing the selection voltage across the pixels.

15. The method of claim 9 comprising the step of energizing the electrodes to establish a post-selection voltage across the first and second pixels after establishing the selection voltage across the pixels but prior to establishing the evolution voltage across the pixels.

16. Display apparatus comprising:

a) a layer of reflective chiral nematic liquid crystal material arranged as pixels;

b) a first set of electrodes and a second set of electrodes spaced on opposite sides of the liquid crystal layer for applying selected energization voltages across multiple pixels; and c) control electronics for setting a display state of the pixels comprising circuitry for:

i) applying a preparation voltage across a selected first pixel during a preparation interval, the selected first pixel being disposed in an overlapping region between one electrode of the first set of electrodes and one electrode of the second set of electrodes during a preparation interval;

ii) applying a selection voltage across the selected first pixel during a selection interval to select a predetermined final display state;

iii) applying an evolution voltage across the selected first pixel during an evolution interval;

iv) repeating steps i)–iii) to apply a preparation, selection, and evolution voltage across a second pixel adjacent to the first pixel to achieve the same predetermined final display state and wherein the step of applying an evolution voltage is performed by applying a sequence of discrete voltage levels having an initial amplitude and a final amplitude and wherein the initial amplitude of the evolution voltage applied to the first pixel is the same as the initial amplitude of the evolution voltage for the second pixel.

17. A method of electrically addressing a liquid crystal display device comprising reflective chiral nematic liquid crystal material disposed between a first set of electrodes and a second set of electrodes arranged on opposite sides of said liquid crystal material that are used to selectively apply an electric field through pixels of said liquid crystal material, the method comprising the steps of:

energizing the electrodes to establish a preparation waveform across a first pixel during a preparation phase, thereafter energizing the electrodes to establish a selection waveform across the first pixel during a selection phase for selecting a final display state of the liquid crystal of the first pixel; thereafter energizing the electrodes to establish an evolution waveform across the first pixel during an evolution phase, and thereafter permitting the first pixel to exhibit the final display state during a non-select interval;

energizing the electrodes to establish a preparation waveform across a second pixel near said first pixel during a preparation phase, thereafter energizing the electrodes to establish a selection waveform across the second pixel during a selection phase for selecting a final display state of the liquid crystal of the second pixel; thereafter energizing the electrodes to establish an evolution waveform across the second pixel during an evolution phase, and thereafter permitting the second pixel to exhibit the final display state during a non-select interval; and providing the evolution waveform of said first pixel with an entry voltage having a amplitude that is about the same as a amplitude of an entry voltage of the evolution waveform of said second pixel.

18. The method of claim 17 wherein the final display state of both the first pixel and the second pixel is focal conic.

19. The method of claim 17 comprising selecting the entry voltage of the evolution waveform of said first pixel and the entry voltage of the evolution waveform of said second pixel to be at a minimum amplitude.

* * * * *